US008544146B2

(12) United States Patent
Curien

(10) Patent No.: US 8,544,146 B2
(45) Date of Patent: Oct. 1, 2013

(54) SMOOTH SURFACE SCRAPER

(75) Inventor: Gerard Curien, Housseras (FR)

(73) Assignee: Winddrop, Fremifontaine (FR)

( * ) Notice: Subject to any disclaimer, the term of this patent is extended or adjusted under 35 U.S.C. 154(b) by 199 days.

(21) Appl. No.: 13/058,355

(22) PCT Filed: Jun. 11, 2009

(86) PCT No.: PCT/FR2009/000703

§ 371 (c)(1),
(2), (4) Date: Feb. 10, 2011

(87) PCT Pub. No.: WO2010/018312

PCT Pub. Date: Feb. 18, 2010

(65) Prior Publication Data

US 2011/0138554 A1 Jun. 16, 2011

(30) Foreign Application Priority Data

Aug. 11, 2008 (FR) ..... 08 55523
Nov. 7, 2008 (FR) ..... 08 57595

(51) Int. Cl.
*A47L 1/08* (2006.01)

(52) U.S. Cl.
USPC ..... 15/401; 15/321; 15/245; 401/139; 401/261

(58) Field of Classification Search
USPC ..... 15/93.1, 236.01, 320, 322, 401, 321, 15/245; 30/169, 123.3, 124, 125; 401/261, 401/263, 265, 266, 139
See application file for complete search history.

(56) References Cited

U.S. PATENT DOCUMENTS

| | | | | |
|---|---|---|---|---|
| 2,893,044 | A | 7/1959 | Keamon | |
| 4,266,317 | A * | 5/1981 | Duda | 15/322 |
| 4,910,825 | A * | 3/1990 | Mauer | 15/121 |
| 4,926,515 | A * | 5/1990 | Lynn et al. | 15/4 |
| 2004/0146332 | A1 | 7/2004 | Fu | |
| 2006/0188320 | A1 * | 8/2006 | Banco et al. | 401/139 |
| 2007/0209133 | A1 * | 9/2007 | Linzell | 15/209.1 |
| 2008/0060156 | A1 * | 3/2008 | Michaels et al. | 15/121 |

FOREIGN PATENT DOCUMENTS

| | | | |
|---|---|---|---|
| CH | 0 681 209 | A5 | 2/1993 |
| DE | 25 27 207 | A1 | 12/1976 |
| FR | 2 106 101 | A | 4/1972 |
| FR | 2 746 625 | A1 | 10/1997 |
| WO | 94 24920 | A1 | 11/1994 |

* cited by examiner

*Primary Examiner* — Mark Spisich
*Assistant Examiner* — Andrew A Horton
(74) *Attorney, Agent, or Firm* — Andrew W. Chu; Craft Chu PLLC

(57) ABSTRACT

The invention relates to a scraper, including a device for projecting-onto a surface through an opening, and a scraping body with a resilient scraping element including a ridge capable of scraping a smooth surface. The body includes, towards a surface of the scraping element, a device for collecting liquid on a substrate absorbing residual liquid connected to a conduit. The device for collecting has an end surface-capable of entering into contact with said surface. The invention also relates to a household appliance incorporating such a scraper.

15 Claims, 5 Drawing Sheets

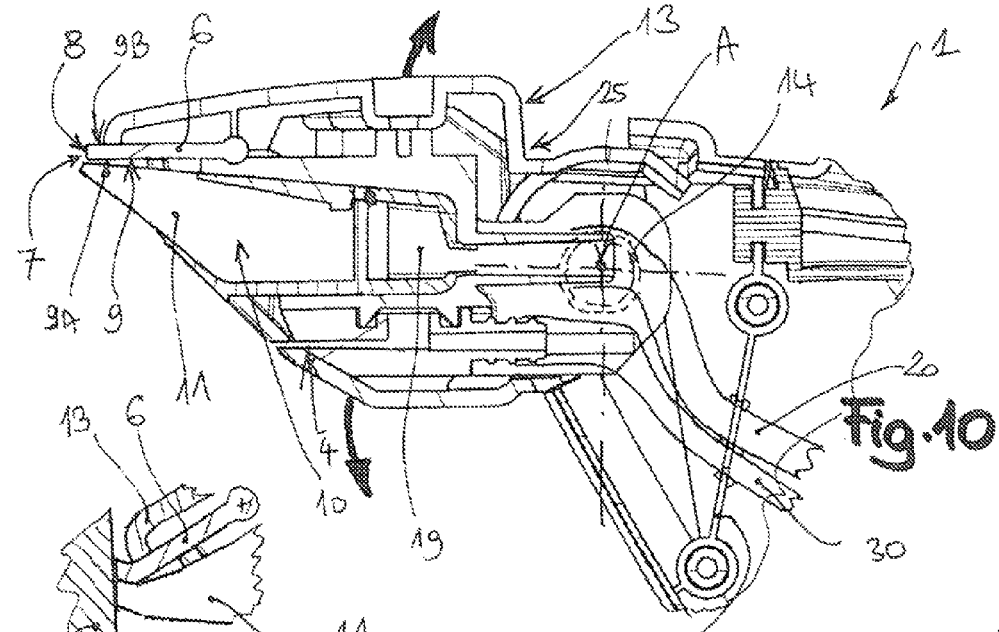
Fig.10
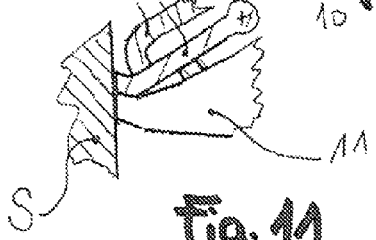
Fig.11
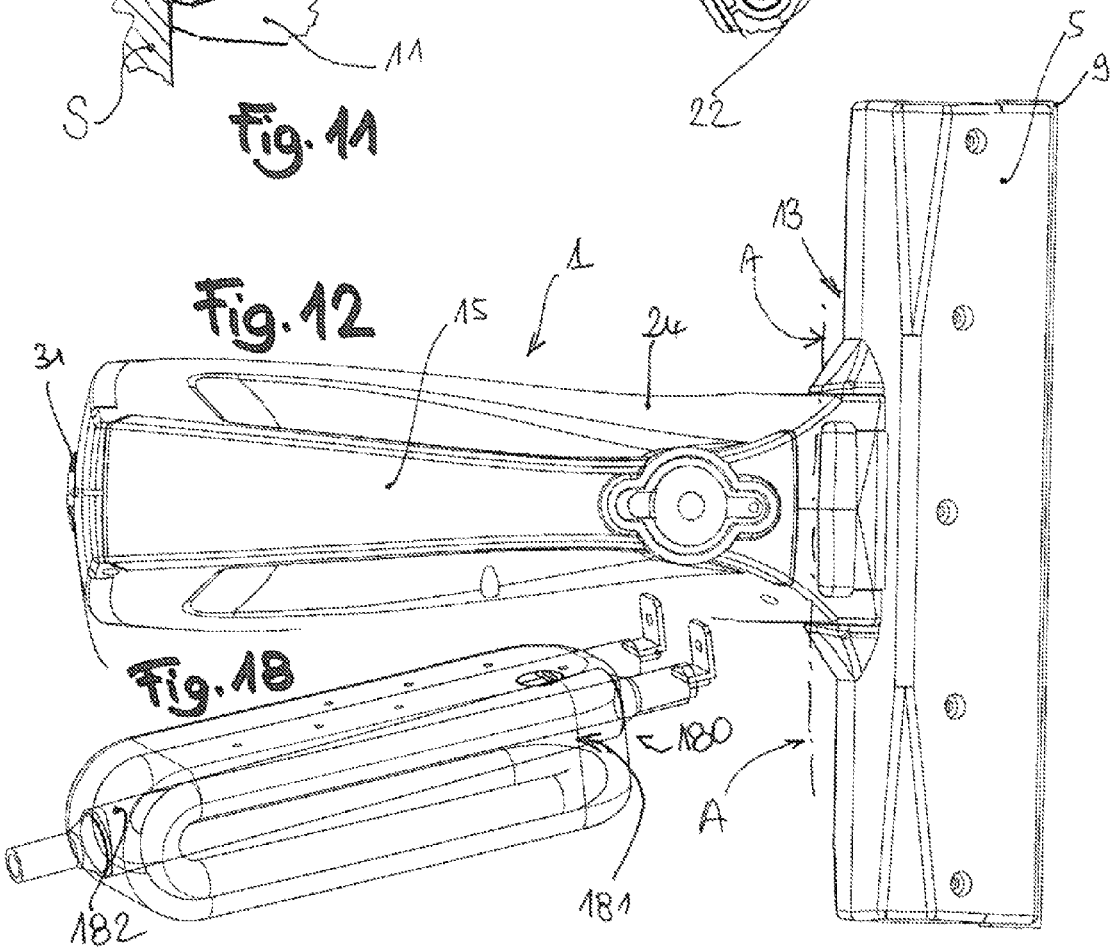
Fig.12
Fig.13

7
10
40
11
6
41
5
4
45
19
44
20
42
20
180
1
3
21
195
18
67
17
31

17
31
67
190
18
3
21
180
20
19
42
44
1
4
45
41
5
40
6
10
7
195

SMOOTH SURFACE SCRAPER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates to a scraper for smooth surfaces, designed capable of being connected to a liquid and/or vapor tank, and including means for projecting liquid or/and vapor onto a work surface through at least one opening, and a scraping body provided with at least one resilient scraping element including at least one ridge formed by the intersection of an edge and a protruding face of said scraping body, which ridge is designed capable of scraping said work surface during a movement imparted to said scraper.

The invention also relates to a household or industrial appliance for cleaning smooth surfaces, including at least one such scraper.

The invention is directed to the field of the cleaning appliances for the maintenance of smooth surfaces, in particular flat, wall or similar surfaces, and in particular the field of the window-scrapers.

2. Description of Related Art Including Information Disclosed Under 37 CFR 1.97 and 37 CFR 1.98.

In order to perform a quality scraping, it is necessary to impart to the resilient scraping element a determined angle of incidence with respect to the work surface. The known window-scraping devices all have the same disadvantage of poor scraping in the end areas, near the frames, in upper areas and close to the floor, and generally in all the areas far away from the user or difficult to be reached from his working position. These devices must then indeed be tilted according to angles inadequate for the user for a proper scraping.

The scraping of windows, in particular, gave rise to devices as the one described in FR 2 746 625, which includes means for emitting vapor and detergent, and means for collecting the residual cleaning liquid, incorporating a capillary substrate. It includes means for putting under pressure or vacuum the circuits for emitting vapor and collecting the residual liquid, respectively. It includes a scraping body in a fixed position with respect to the rest of the appliance, which does not enable its handling in all positions. The recovery of the residual liquid occurs by vacuum, which requires a dedicated circuit for this use. From WO9424920 is also known a household vacuum cleaner provided with a scraper, and a ventilator generating vacuum for the evacuation of the residual liquid, which results into noise, extra size, extra cost, and limited handiness.

SUMMARY OF THE INVENTION

The aim of the present invention is to cope with the problems of the state of the art by providing a light and handy device allowing avoiding drips and traces on cleaned surfaces, and allowing quality scraping in any area of the work surface, with great ergonomics in use, which enables its use in all usual working positions, and namely both in the upper and lower portions of a vertical surface. The invention pretends to provide a small-size manual appliance allowing its easy use with one hand, of very low cost, with a reduced number of components, usable alone or in combination with another household or industrial cleaning appliance.

To this end, the invention relates to a scraper for smooth surfaces designed capable of being connected to a liquid and/or vapor tank, and including means for projecting liquid or/and vapor onto a work surface through at least one opening, and a scraping body provided with at least one resilient scraping element including at least one ridge formed by the intersection of an edge and a protruding face of said scraping body, which ridge is designed capable of scraping said work surface during a movement imparted to said scraper, wherein said scraper is designed capable of collecting washing residues and, to this end, said scraping body includes, in the vicinity of said scraping element and at least towards or on one surface of the latter, means for collecting residual liquid on at least one absorbent substrate guiding the residual liquid connected to a tank by a conduit, and said means for collecting residual liquid include an end surface designed capable of entering into contact or nearing said surface of said scraping element.

According to a feature of the invention, said means for collecting residual liquid are movable in rotation or/and in translation, either with respect to said scraping head, which they are connected to by springy restoring means and pivoting means, or with respect to an end of said scraper for being gripped by the user or designed capable of being connected to an appliance handled by the user.

According to a feature of the invention, said surface and said end surface are separated from each other under the action of said springy restoring means and said pivoting means, and, under an action of displacement and/or pressure by the user of said scraper on a work surface, said surface and said end surface are brought close to each other.

According to another feature of the invention, said scraping body forms a pivoting head or is mounted on such a pivoting head, which is designed capable of pivoting between two extreme positions and tends to be restored into a resting position by compression means.

The invention thus sees to it that, irrespective of the slope of the scraper with respect to the surface to be cleaned, or at least with respect to a plane locally tangent to this surface, if the latter is deformed, the absorbent surface is always in contact with the surface to be cleaned. This is why it has been chosen to make the means for collecting residual liquid movable with respect to a scraping head or with respect to an end of the scraper.

Further features and advantages of the invention will become clear from the following description of same, given as an indication and by no means restrictively, with reference to the attached drawings.

BRIEF DESCRIPTION OF THE DRAWINGS

FIG. 10 shows, in a schematic, partial and cross-sectional view, a detail of a scraping body equipping the scraper of FIG. 8.

FIG. 11 shows, in a schematic view, a detail of FIG. 8 in a position during the work of scraping a work surface.

FIG. 12 shows, in a schematic and top view, the scraper of FIG. 8.

FIG. 18 shows, in a schematic, perspective and transparent view, means for heating liquid or/and gas usable in the invention.

DETAILED DESCRIPTION OF THE DRAWINGS

The invention is directed to the field of the cleaning appliances for the maintenance of smooth, namely flat surfaces, and in particular the field of the window-scrapers.

The invention relates to a scraper 1 for smooth surfaces, which can namely be designed in the form of a vapor window-scraper. This scraper 1 includes, as the case may be:

- in an autonomous version, a tank 2 for liquid, detergent or clean water or the like, or/and vapor, and pulverization means for vaporizing this liquid, or/and means for generating or transmitting vapor 3, namely vapor generated from the liquid contained in this tank 2; or
- in a version in which the scraper 1 is the accessory of another household or industrial appliance, means for transporting 30 liquid or/and also vapor produced upstream of the scraper 1.

Figure 1:
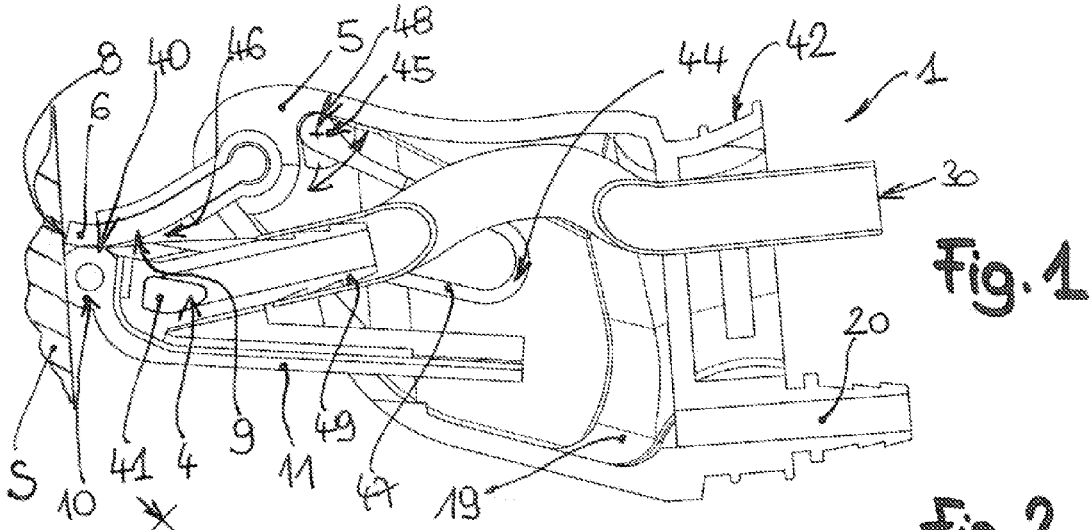
FIG. 1 shows, in a schematic and cross-sectional view, a scraper in a first variant of a first embodiment of the invention, in a closed position in which the means for collecting the residual liquid are in contact with the scraping element.

The scraper 1 includes means for pulverizing liquid or/and injecting vapor 4 onto a work surface S, by ejection through at least one opening 41, as can be seen in FIG. 1, for example at the level of at least one nipple 49.

In the autonomous version, the advantage of the existence of integrated means for generating vapor 3 is guaranteeing, especially when the scraper 1 is manual and portable, a certain limitation of the heating power, imposed by the size and the weight, and thus guaranteeing an energy saving.

In the present description, clean water designates a solution free from dirt and impurities, consisting for example of water or/and a detergent or washing product. The residual liquid or dirty water here designates a solution including dirt or/and impurities of the surface to be cleaned, which are collected in order to eliminate them.

Clean water and dirty water can, depending on the variant of the appliance that is used, either be mixed in one single filtering tank or remain separate in the case of separated tanks, or in the case of one single tank with separation of the volumes reserved for clean water and for dirty water, which will be described below.

The scraper 1 includes at least one scraping body 5, which is provided with at least one resilient scraping element 6. The latter includes at least one ridge 7 formed by the intersection of an edge 8 and a protruding surface 9 of said scraping body. The ridge 7 is designed capable of scraping the work surface during a movement imparted to the scraper 1.

In a preferred version, the scraper 1 is manual, and the movement imparted to it is a movement of the user's arm or wrist.

According to the invention, the scraper 1 is designed capable of collecting washing residues, solid or/and liquids. To this end, the scraping body 5 includes, proximate the scraping element 6 and at least towards or on a surface 9 of the latter, means for collecting residual liquid 10 onto at least one absorbent and residual-liquid guiding substrate 11, which is connected to a liquid-collection channel 20, which can itself be connected to a tank, in particular a liquid-collection tank 12, and advantageously passing through a non-return valve 195. This channel 20 can be reduced, as the case may be, to a simple communication opening. These collection means 10 allow a perfect collection of the residual liquid at the level of the work surface S, and scraping without traces.

Figure 4:
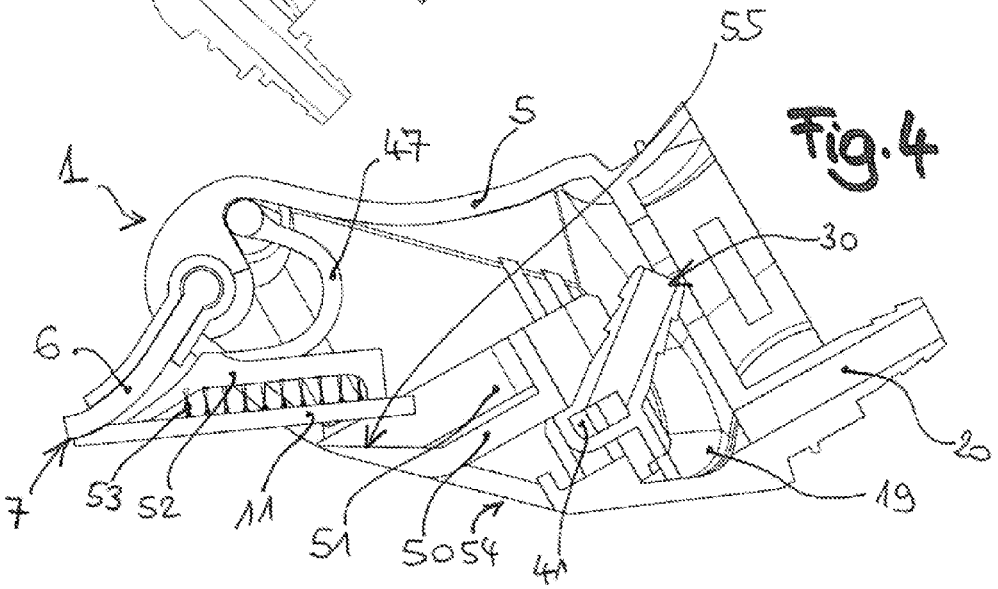
FIG. 4 shows, in a schematic and cross-sectional view, a scraper in a second variant of a first embodiment of the invention, in a closed position.
Figure 5:
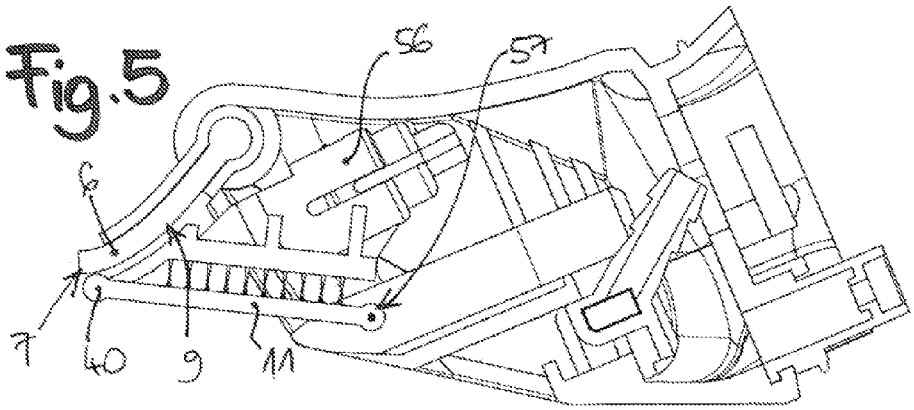
FIG. 5 shows, in a schematic and cross-sectional view, a window-scraper in a third variant of a first embodiment of the invention, in a closed position.

The function of the absorbent and residual-liquid guiding substrate 11 is to recover the residual liquid by capillarity before its evacuation into a conduit 20. It is also useful for retaining, in its thickness, and thus without staining or scratching the work surface S, dirt or/and impurities the latter includes. It is also useful to provide a very easy replacement of this absorbent substrate 11. Effective and cheap fastening means consist in using a Velcro, as can be seen in FIGS. 4 and 5. One can also advantageously use volumes such as mushroom-shaped barbs or the like directly injected into this substrate, designed capable of co-operating with complementary volumes in order to ensure their holding. The absorbent substrate 11 can also result from weaving natural, synthetic threads, micro-fibers or the like, permitting the absorption of a liquid. It can also be fastened together by pinching.

The collection of residual liquid towards the liquid-collection tank 12 preferably occurs by gravity. To this end, the latter is in the lower portion of the appliance, i.e. below the user's hand, located at one end of the scraper 1 opposite the scraping body 5, when the scraper 1 is a manual scraper in the preferred use visible in the figures. In an advantageous variant, this collection tank 12 can form the gripping handle of the appliance, or be incorporated into the latter. It is of course also possible to connect the liquid-collection channel 20 to suction means.

In order to perform quality scraping, it is necessary to impart to the resilient scraping element 6 a determined angle of incidence with respect to the work surface. Therefore, in an innovating way, the scraper 1 according to invention is arranged so as to allow quality scraping in any area of the work surface, and in particular in both the upper portion and the lower portion of a large-size vertical surface, such as a French window the panes of which one wants to clean in one single operation.

According to an advantageous feature of the invention, the means for collecting residual liquid 10 are movable in rotation or/and in translation either with respect to the scraping head 5, which they are connected to by springy restoring means 44 and by pivoting means 45, or with respect to an end 42 of the scraper 1, which is designed for being gripped by the user or which is designed capable of being connected to an appliance handled by the user.

In a simple and cheap version of the invention, these springy restoring means 44 and these pivoting means 45 can be formed by one and the same component, for example an elastic connection element 47 as can be seen in FIG. 1. The latter can be, as the case may be, fastened to the scraping body 5 or mounted movable in rotation with respect to the latter about at least one pivoting axis 48.

According to the invention, the means for collecting residual liquid 10 include an end surface 40 designed capable of entering into contact or close to the surface 9 of the scraping element 6, in order to remove as much as possible the quantity of residual liquid on the surface to be cleaned.

The invention sees to it that, irrespective of the slope of the scraper 1 with respect to the surface S to be cleaned, or at least with respect to a plane locally tangent to this surface S, if the latter is deformed, the absorbent surface is always in contact with the surface to be cleaned. This is why it has been chosen to make the means for collecting residual liquid movable with respect to the scraping head or with respect to an end of the scraper.

Advantageously, the invention is designed to implement an absorbent substrate fastened directly under the scraping element 6 in a fixed position. The compression of the scraping element 6 then allows this absorbent substrate to enter into contact with the surface S to be cleaned, and to directly absorb the solid residues or/and washing liquids on it.

In short, the invention implements, according to its variants of embodiment, the whole or part of the means allowing:

- the articulation of the scraping portion with respect to surface to be cleaned, in order to allow maximum ergonomics and a great comfort of use;
- the absorption of the residues by means arranged, as the case may be, fixed under the scraping element, above the means for pulverizing liquid or/and generating or transmitting vapor, and/or on the latter, movable between the scraping element and the latter, or arranged on the latter; and
- the recovery of the residues, in a recovery area, while guiding them towards a tank, with means for separating between on the one hand the solid residues, which must be insulated by a stop formed by the absorbent substrate that is designed capable of retaining them, and on the other hand the liquid residues, which, in some embodiments, can be recycled for washing; the invention sees to it that the means for collecting and the means for storing the liquids allow working in various positions.

A first embodiment is shown, according to various variants, in FIGS. 1 to 7 and 15. A second embodiment is shown in FIGS. 8 to 12. These two embodiments can also be combined.

In the first embodiment as visible in FIGS. 1 to 7 and 15, according to the invention, in a free state, the surface 9 of the resilient scraping element, on the one hand, and the end surface 40 of the absorbent substrate guiding the residual liquid 11, on the other hand, are separated from each other under the action of the springy restoring means 44 and the pivoting means 45. Under the effect of an action of displacement and/or pressure by the user of the scraper 1 on a work surface S, the surface 9 and the end surface 40 are brought close to each other. They can, in a preferred embodiment, come close until they enter into contact with each other. Bringing the absorbent substrate 11 and the scraping element 6 close to each other provides great quality of finishing, and allows avoiding the subsistence of dirty water on the surface S to be cleaned.

In either embodiment, the absorbent substrate 11 is positioned either above or below, but preferably in front of at least part of the projection opening or openings 41, which the projecting means 4 include, so that the projected liquid or gas flow passes through it, thus avoiding splashes of condensed vapor droplets or cleaning product on the floor.

In a particular embodiment of the invention, at least part of the projection opening or openings 41 the projecting means 4 include is positioned between the surface 9 and the end surface 40, so as to be able to project a liquid or gas flow between the latter, preferably when they are separated from each other, in a channel 46 formed by their separation. Advantageously, at least part of the projection openings 41 is located under the absorbent substrate 11, i.e. so that the projection of the gas or liquid jet controlled by the user passes through the latter.

The invention allows to permanently carry out the simultaneous projection and recovery of liquid. It thus provides a significant advantage over the prior art, while permitting to permanently have clean cleaning liquid, and while permitting a projection at high temperature on a cold surface S to be cleaned. The permanent abundance of cleaning liquid permits to push back the solid particles, to maintain the cleanliness of the surface S to be cleaned, to degrease the latter very effectively. An additional advantage deriving from this permanent circulation resides in the longevity of the absorbent substrate, which can be cleaned periodically for removing the solid residues it collected, and re-used.

The absorbent substrate guiding the residual liquid 11 is formed of at least one spongy body designed capable of collecting the residual liquid, and of transmitting it, by gravity, into a collection chamber 19, then through a conduit 20 towards a tank, in particular a liquid-collection tank 12.

Figure 2:
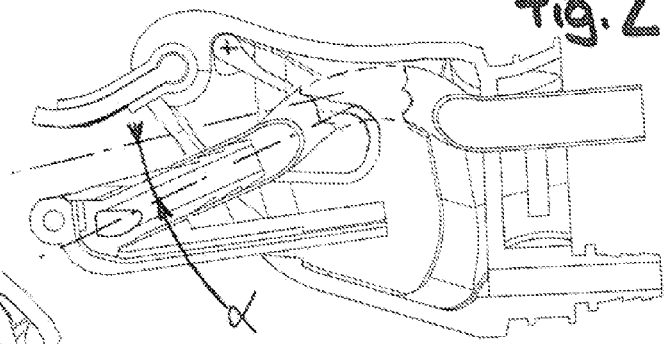
FIG. 2 shows, in a schematic and cross-sectional view, the scraper of FIG. 1, in an opened position in which the means for collecting the residual liquid are away from the scraping element.
Figure 3:
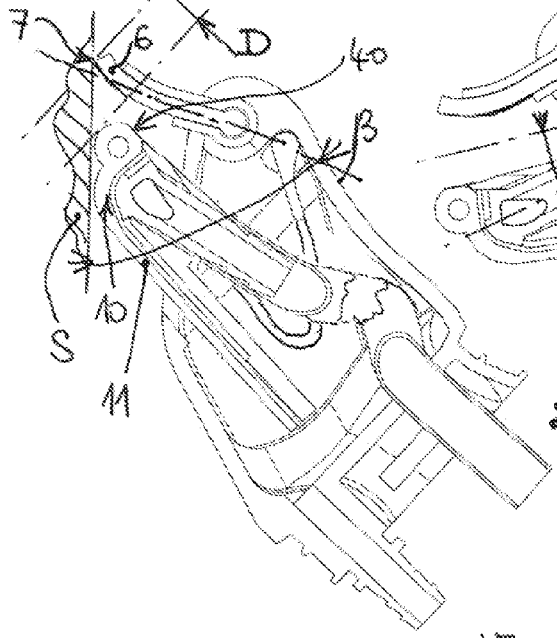
FIG. 3 shows, in a schematic and cross-sectional view, the scraper of FIG. 1, in an opened position in which the means for collecting the residual liquid are withdrawn from the edge of the scraping element.

FIGS. 1 to 3 show a first variant of embodiment. FIG. 2 shows a scraper 1 according to the invention, in the free state, the surface 9 of the resilient scraping element 6, on the one hand, and the end surface 40 of the absorbent substrate 11 guiding the residual liquid 11, on the other hand, are separated from each other under the action of the springy restoring means 44 and the pivoting means 45. The support of the absorbent substrate 11 is then angularly separated according to an angle $\alpha$ with respect to its position in FIG. 1, where the surface 9 and the end surface 40 are in contact.

The substrate 11 is preferably made as foam. Advantageously, the means for collecting residual liquid 10 are mounted on a removable support dismountable by simple extraction, in particular with the substrate 11 incorporated into a removable cartridge for simple and fast replacement. If the absorbent is mounted firmly, foam or/and textile substrates can be used.

FIG. 3 shows an initial phase of cleaning in an upper position with respect to the user. The collecting means are in contact with the scraping element, but with a position of the scraper 1 more inclined than in FIG. 1. The end 40 positions itself along the work surface S, under the ridge 7, during the descending movement imparted by the user. The springy restoring means 44 and the pivoting means 45 permit a movement in rotation or/and in translation of the absorbent substrate 11 with respect to the scraping element 6, and thus permit an offset D between the ridge 7 of the scraping element 6 and the end surface 40. This permits cleaning under good conditions, by ensuring a permanent contact according to the slope of the appliance with respect to the surface S. One understands that, depending on the angle of incidence β of the scraping element 6 with respect to the work surface 7, the offset D can be on either side with respect to the ridge 7, and thus that the end surface 40 can be re-entrant with respect to the scraping ridge 6, as in FIG. 3, in the upper portion of a vertical surface, or protruding in the lower portion of the same vertical surface close to the floor. One understands that the articulation of the support of the absorbent substrate 11 has the advantage of permitting that the latter remains in contact with the surface S to be cleaned, without having therefore having to maintain a too strong pressure on the scraping element 6. This articulation allows a much broader and much easier orientation of the scraper 1 than the prior art, depending on the constraints of positioning of the user, in height and distance with respect to the surface S.

FIG. 4 shows a second variant, including a movable or removable drawer 50, which allows an easy access to the substrate 11 for its maintenance. The substrate 11 is shown fastened by a Velcro 53 to a support 52, which is connected, by means of an elastic connection element 47, to the scraping head 5. The residual liquid collected by the substrate 11 flows into a chamber 51 the drawer includes, before flowing into a chamber 19 the scraping head 5 includes, then into the conduct 20. The liquid or vapor pulverization or injection opening 41 communicates with at least one outlet opening 54, preferably positioned beyond the absorbent substrate 11 from the ridge 7. The drawer 50 preferably includes a stop surface 55 limiting the hub of displacement of the substrate with respect to the scraping head 5, and guiding the liquid collected in the chamber 51.

FIG. 5 shows a third variant related to another embodiment of the springy restoring means 44 and the pivoting means 45, shown in the form of pistons 56 and of a pivot 57.

Figure 6:
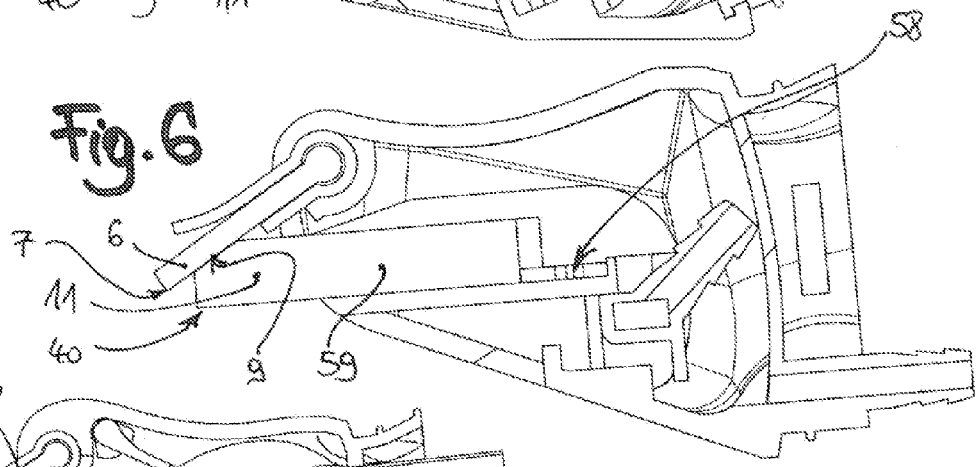
FIG. 6 shows, in a schematic and cross-sectional view, a window-scraper in a fourth variant of a first embodiment of the invention, in a closed position.

FIG. 6 shows a fourth variant, in which the substrate 11 is formed of a block of foam 59 forming per se, because of its flexibility, pivoting means 45 for the end 40, the springy restoring means 44 tending to cause this end to be protruding being formed by a spring 58 or the block of foam 59 itself.

Figure 7:
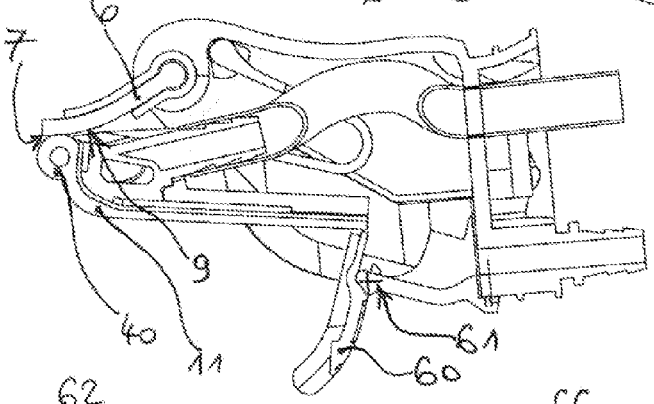
FIG. 7 shows, in a schematic and cross-sectional view, a window-scraper in a fifth variant of a first embodiment of the invention, in a closed position.

In order to facilitate the maintenance, the replacement or the cleaning of the substrate 11, the scraper 1 advantageously includes at least a cover 60, for example pivoting about an axis 61, according to the fifth variant visible in FIG. 7, which allows an easy replacement of the absorbent substrate, either fastened by means of a Velcro or the like, or incorporated into a removable cartridge.

The scraping body 5 is advantageously isolated from the rest of the scraper 1 by a sealed partition 22, through which passes at least one liquid or vapor supply conduit 23 and by at least one liquid collection channel 20.

The articulated support of the absorbent substrate provides the desired ergonomics and quality of work, in all the usual positions and even on surfaces away from the user.

Of course, the features of these various variants can be combined, and do not restrict the embodiments of the invention. The variants set forth are very suitable for mass production, for producing a reliable and inexpensive product.

In the second embodiment, as can be seen in FIGS. 8 to 12, the scraping body 5 forms a pivoting head 13 with respect to end 42, or is mounted on such a pivoting head 13, which is designed capable of pivoting about an axis A between two extreme positions and tends to be restored into a resting position by compressing means 14. It is then the articulation of the pivoting head 13 itself and the flexibility of the absorbent substrate 11 that facilitate the contact of the latter with the surface S depending on the position of the user. In order to ensure an optimal finishing, the absorbent substrate 11 is, at the level of the scraping portion, advantageously protruding according to a V-shaped or gutter-shaped profile, in order to avoid, in the resting position, any interposition between the scraping portion and the surface to be cleaned.

Depending on the position of the user, the scraping body 5 is more or less inclined downwards with respect to a body 24 the scraper 1 includes, which body 24 preferably integrates in his upper portion 16 at least one liquid or clean water tank 2, and in its lower portion 17 at least one liquid-collection tank 12, provided with draining means such as a plug 31, which can also be used for connecting an evacuation hose or the like. Thus, the residual liquid or dirty water collected flows downward by gravity, from the absorbent substrate guiding the residual liquid 11, through a rear area 25 of the scraping body 5, through at least a liquid collection channel 20, to reach the liquid collection tank 12, progressively with the movements of the user.

The pivoting head 13 permits to achieve the desired quality scraping, and the rotary effect permits to preserve the effect of gravity, at the same time as perfect ergonomics, in any working position of the user. It also guarantees the quality of the work performed, irrespective of the area of the work surface to be scraped.

In a preferred embodiment of the invention, the compression means 14 are springy restoring means, and can in particular be formed of one or several metallic or plastic springs.

The scraper 1 can, in particular depending on the type of tasks to be performed, be configured in various ways: in a first variant of embodiment, the resting position of the pivoting head 13 is one of the extreme positions between which it is designed capable of pivoting. In a second variant of embodiment, the resting position is an intermediate position between these extreme positions. In yet another variant of embodiment, the scraper 1 includes means for adjusting the resting position of the pivoting head 13, for example using by means of a notched thumb-wheel or the like.

Both in the first or the second embodiment of the invention, the scraping element 6 can include several surfaces 9A, 9B, protruding out of the scraping body 5. In this embodiment, and on each such surface 9A, 9B, it advantageously includes means for collecting residual liquid 10 on at least one absorbent substrate guiding the residual liquid 11 connected to a liquid collection tank 12, preferably one single tank.

The scraping element 6 advantageously includes a V-shaped scraping front on a surface of which rest grooves or channels designed capable of guiding the liquid towards the collecting means.

Both in the first or the second embodiment of the invention, the absorbent substrate guiding the residual liquid 11 is preferably formed of at least one spongy body designed capable of collecting the residual liquid or dirty water and of transmitting it, by gravity, towards the liquid collection tank 12. The absorbent substrate guiding the residual liquid 11 is preferably made of textile material of natural or synthetic material, or of a compact material such as natural sponges, or synthetic sponges of micro-fibers, PP, EPP, PU, PVA, "Nylon", silicone, polyester, cellulose, phenolic foam, or the like. This substrate 11 is preferably chosen with shape memory.

The absorbent substrate guiding the residual liquid 11 can be directly in contact with the resilient scraping element 6, the latter being preferably formed by a seal, which permits to avoid the formation between them of a water edging that would remain on the work surface S when removing the scraper 1. The substrate 11 can be protruding beyond the resilient scraping element 6. During its application onto the work surface S, it is then compressed, and follows much better the deformations of the resilient scraping element 6.

The scraping element 6 advantageously includes, according to the patent application FR 2 909 275 of the same applicant, a not very deformable V-shaped scraping front, on a surface of which rest grooves or channels designed capable, on the one hand, of guiding the liquid or gas towards the area of contact with the surface to be cleaned or/and, on the other hand, of facilitating the draining into the absorbent substrate 11 by addition of air. One can then add an absorbent substrate directly under this scraping element, which is then maintained in front of the surface S to be cleaned by the angle or the form of the profile of this scraping front. This system is particularly well suited for very small-size, very compact and light appliances designed capable of being held with the hand.

The ergonomics of the scraper 1 according to the invention is designed so that, in a preferred manual version of the scraper 1, its centre of gravity is located at the level of the user's hand or below same. In particular, the scraper 1 preferably includes a handling handle 15 in its upper portion 16. This handling handle 15 advantageously includes at least part of the clean-water tank 2 or/and of the collection tank 12.

The liquid collection tank 12 is preferably located in the lower portion 17 of the scraper 1, and advantageously includes displacement preventing means, in order to prevent any displacement of water when the appliance is tilted. These displacement preventing means include an inlet 18 in the upper portion of the latter or/and a non-return valve, or the like.

The scraper 1 advantageously includes an accumulation chamber 19 between the absorbent substrate guiding the residual liquid 11 and the liquid collection channel 20.

In a particular version, the scraper 1 includes at least one rolling means, such as a roller or the like, designed capable of rolling on the work surface. The scraping body 5 advantageously forms a head 13 pivoting by counterweight, thus avoiding the use of a restoring mechanism. The conjugation of this rolling means and this head pivoting by counterweight permits a version with a low manufacturing cost.

Such rolling means can be formed of a roller supplied with the absorbent substrate, placed under the scraping element 6, this roller including also anti-sliding and anti-slip surfaces, for example made of sufficiently compressible rubber, in order to roll while descending along the surface to be cleaned, and while collecting the residues that are also pushed towards the liquid collection channel 20 under the action of the compression of this roller during its reversed rolling motion.

Figure 17:
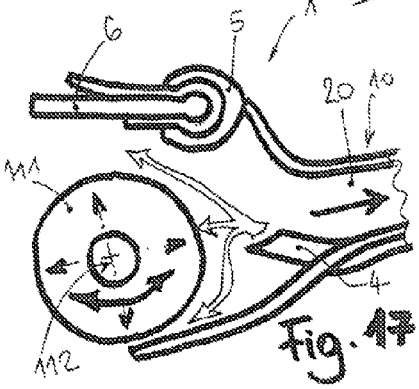
FIG. 17 shows, in a schematic and cross-sectional view, a rotary absorbent substrate usable in the invention.
Figure 9:
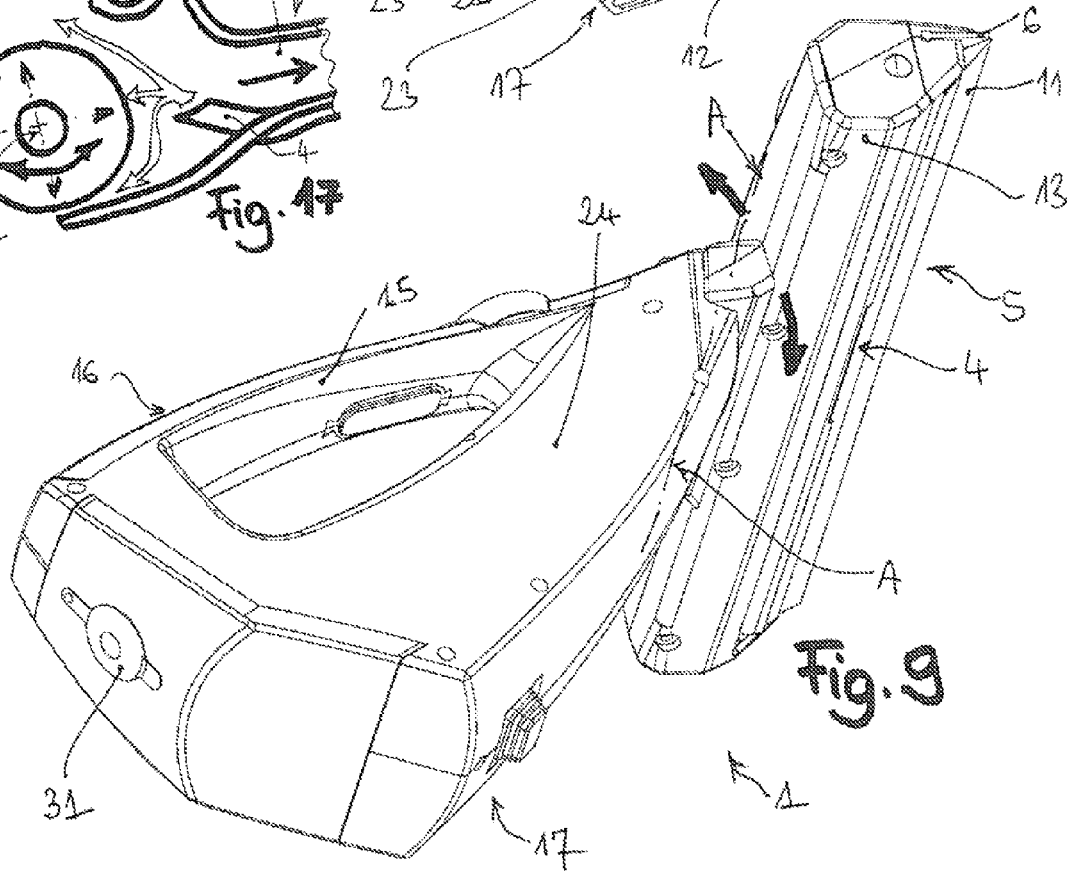
FIG. 9 shows, in a schematic and perspective view, seen from below, the scraper of FIG. 8, in an opened position.

FIG. 17 shows a substrate 111 rotating about an axis of rotation 112, subjected to the action of springy restoring means 44 and pivoting means 45 not shown in the figure. The injection of fluid occurs under the rotary substrate 111, or/and between the rotary substrate and the scraping element. The means for collecting residual liquid 10 are formed of a conduit 20. During its rotation, the downward movement of the scraping element causes the rotary substrate 111 to rotate in the opposite direction, which drives the residues under the scraping element towards the conduit 20. This embodiment is also very well suited for a connection to suction means at the level of the latter: the liquids are sucked up permanently in the case of an ejection under the absorbent substrate. This principle shows its effectiveness for the cleaning of horizontal surfaces S. It is then possible to combine a double scraping with pulverization on the center of the rotary substrate 111, which is combined with at least two scrapers located on both sides of its axis of rotation, and which can then work in alternating direction, while guaranteeing an impeccable finishing, because of the proximity between the scraping element and the absorbent substrate mounted on an articulation, unlike with the systems of the prior art, which cannot evacuate the liquid retained by capillarity at the level of the surface to be cleaned.

The scraper 1 preferably includes manual or electric means for pumping liquid or clean water 21 designed capable of putting under pressure the vapor coming from the vapor-generating means 3, the latter including preferably at least one heating body.

The pivoting head 13, or the scraping body 5 it can include, is preferably isolated from the rest of the scraper 1 by a tight partition 22 through which passes at least one liquid or vapor supply conduit 23 and at least one liquid collection channel 20.

The invention also relates to a household or industrial cleaning appliance for smooth surfaces, including at least such a scraper. Though the present description shows a manual scraper, in particular beneficially usable for the cleaning of window surfaces or the like, it is understood that the features of the invention are also applicable to movable cleaning appliances, such as motorized carriages for the scraping of dirty water after the surface washing of floors or the like. In such appliances, the evacuation of dirty water that cannot occur by gravity then occurs through means for sucking up the residual liquid the appliance includes.

In a variant of embodiment, the scraper 1 thus includes means for connecting to another household appliance, which it is an accessory of, for example at the level of a pipe or a hose. This other household appliance, whether portable or not, can be a vacuum cleaner. It can also be, or include, a vapor generator without suction, it is then enough for the scraper 1 to include means for transporting 30 this vapor.

Another household appliance, the scraper 1 of which is the accessory, can also simply ensure an additional clean-water capacity or a liquid collection for this scraper 1. The scraper 1 according to the invention is then portable, manual. It is interesting that the scraper 1 includes a tank for collecting the liquid carried along 12.

Indeed, if the user handles the scraper 1 downwards of another household appliance, which it is an accessory of, he is thus certain he collects the dirty water without any displacement or siphon effect. The scraper 1 can also include only vapor-generating means 3, but no clean-water tank, the latter then being remote and incorporated in the other household appliance the scraper 1 of which is the accessory, the latter including only pumping means 21 for supplying the clean water 1 to these means 3.

These pumping means 21 can be manual or electric means, and in particular in the latter case, with permanent maintaining under pressure of the clean water, and release by a simple trigger.

Figure 8:
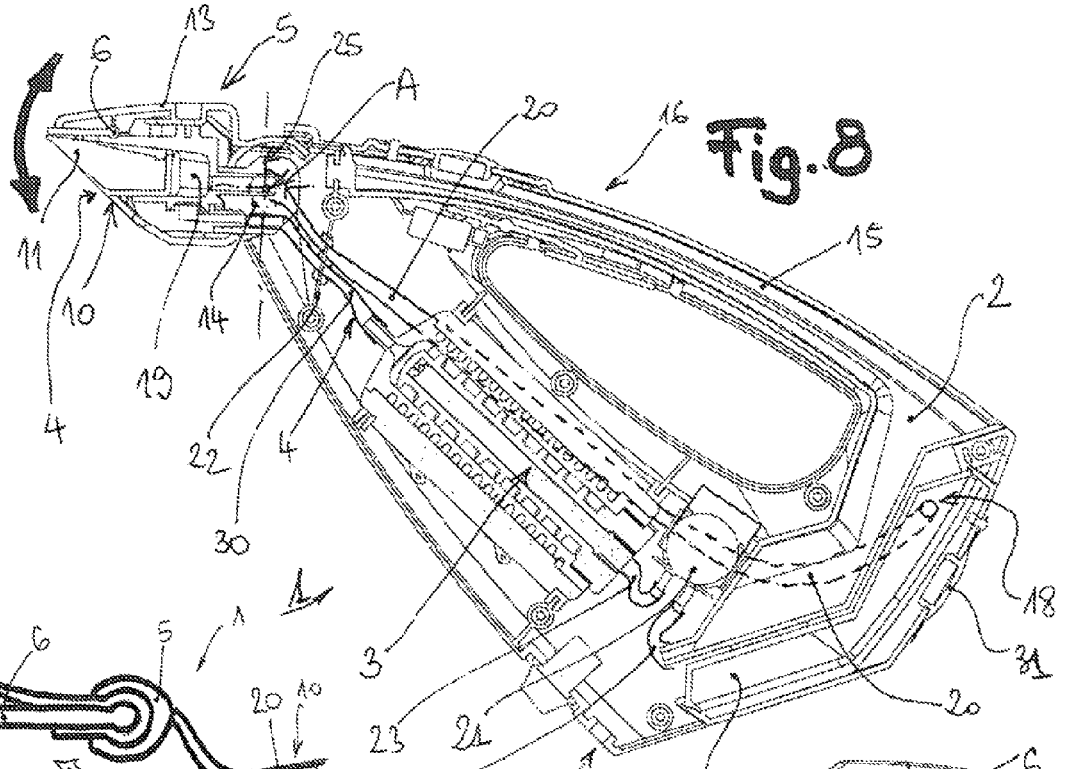
FIG. 8 shows, in a schematic and cross-sectional view, a window-scraper in a second embodiment of the invention.
Figure 15:
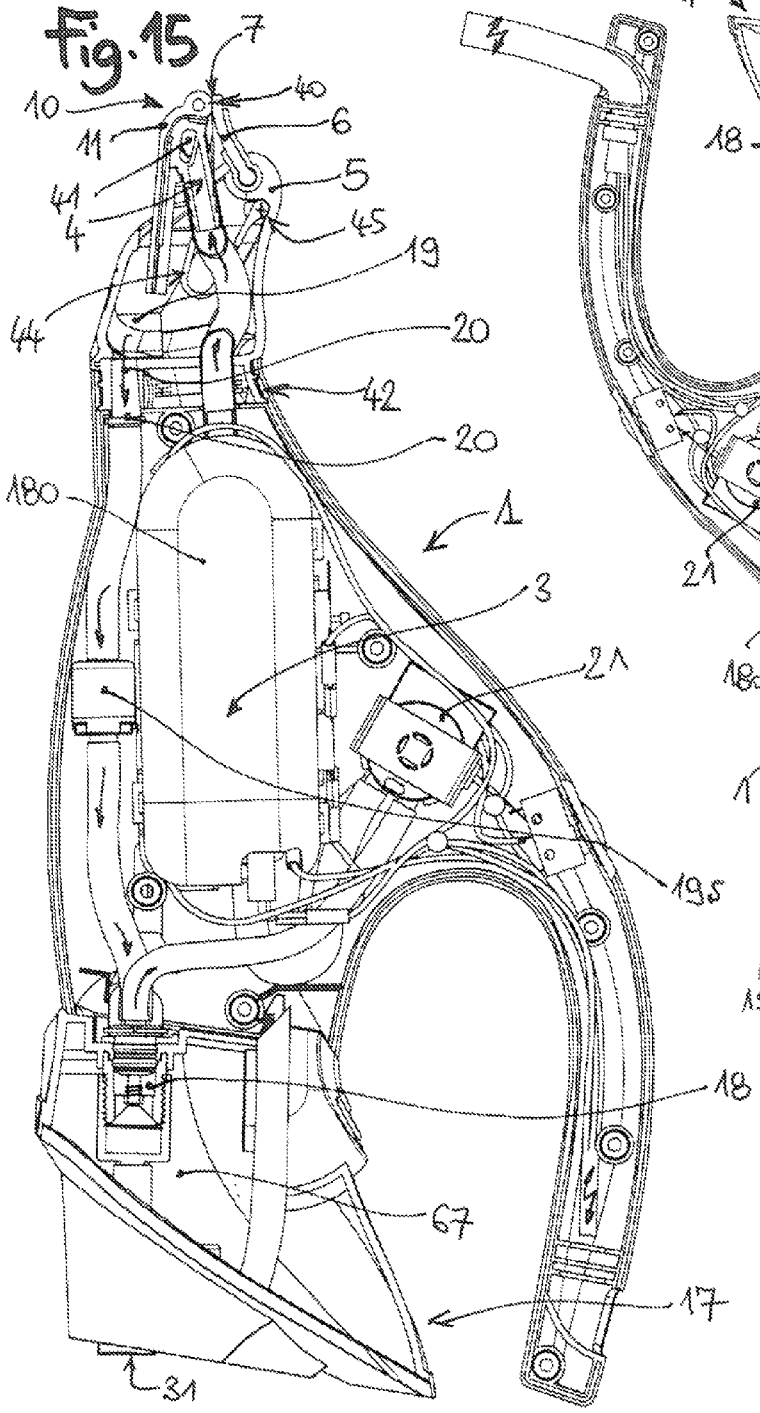
FIG. 15 shows, in a schematic and cross-sectional view, a vapor-cleaning appliance incorporating the scraper of FIG. 1.

In a particular embodiment, whether in the first or the second embodiment of the invention, the appliance integrating the scraper 1, or the scraper 1 if it constitutes an integrated appliance as visible in FIGS. 8 and 15, includes a liquid collection tank 12 located at an end opposite the scraping body 5, and includes displacement-preventing means for preventing any displacement of liquid when the scraper 1 is tilted. The latter include an entry 18 directed towards the scraping body 5 or/and a non-return valve.

Advantageously, a manual scraper 1 includes a handle that integrates a tank the liquid of which is extracted either by a simple pressure on the body of this tank or by means for pulverizing or injecting liquid or vapor 41, or by a simple nozzle.

The scraper 1, or head 13 as the case may be, can be united to a mast, in particular a telescopic mast, or to a tube of the same type incorporating the means for guiding the cleaning fluid and/or the means for collecting 20 the dirty water towards the body, including at least one liquid tank, of a household or industrial appliance arranged on the floor or carried by the user. This telescopic tube can be fixed to a hose, or be formed by at least one hose, or can be interposed between the body and the head of the appliance and/or integrated in the tank, in order to reduce the total size while preserving the space necessary for a heating body. In an advantageous variant of embodiment, the means for guiding the cleaning fluid and/or the collection means 20 are in the form of an extensible coil. In a preferred version, the appliance thus includes a body movable on the floor or carried by the user, for example at the waist or in a shoulder-belt, connected by a hose and/or such a telescopic conduit to the scraping body itself. In the case of a body movable on the floor, it is possible to add suction means, which are separated from the manual scraper for reasons of weight and, of course, the scraper then includes sealing means specific to this suction circuit, which is in addition to the means for collecting by gravity. It can then be contemplated to scrape floor surfaces. In the event suction means are used, their connection can advantageously occur at the level of a suction casing receiving the absorbent substrate and the scraping body.

Both in the first or the second embodiment of the invention, the scraper 1 can advantageously include one single tank 67 for the clean liquid and the collected residual liquid. In a very simple version, made possible by the good quality of filtering of impurities at the level of the absorbent substrate 11 of the scraper according to the invention, the residual liquid is simply mixed to the clean liquid; only one fluid is thus circulating in the appliance, with filtering of the mixture before its expelling, for example at the level of the filtering means, or also of an intermediate filter partition, designed capable of filtering the residual liquid, separating a first inlet chamber for this residual liquid and a second chamber for recycled liquid.

Figure 13:
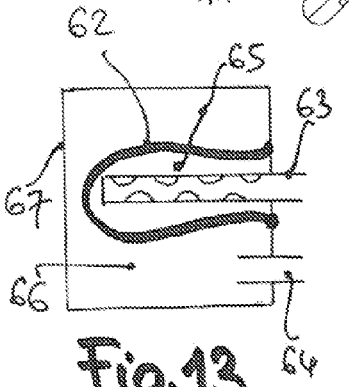
FIG. 13 shows, in a schematic and cross-sectional view, a tank with two compartments designed capable of equipping a scraper according to the invention, according to a first distribution of these compartments.
Figure 14:
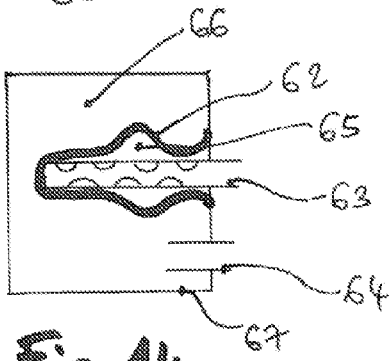
FIG. 14 shows, in a schematic and cross-sectional view, the tank of FIG. 13, according to another first distribution of these compartments.

In a version in which the circuits remain separated, the single tank 67 includes, as can be seen in FIGS. 13 and 14, a chamber 65 for clean liquid supplied through a conduit 63, ending for example with a tube provided with namely radial openings or drillings, and a chamber 66 for residual liquid supplied through a conduit 64 connected to the conduit 20 or formed by the latter. The chambers 65 and 66 are separated by a deformable flexible partition 62, such as a windbag, fixed around the conduit 63, and namely fixed to the wall of the tank 67. The losses of liquid are very small, and the total volume formed by the two chambers is almost constant. FIG. 13 shows a state at one moment prior to that of FIG. 14. This type of tank permits to work in all positions, and allows any type of appliance architecture, namely on a power sweeper or a sledge-type vacuum cleaner, the liquid generating tank being positioned as close as possible to the floor.

Figure 16:
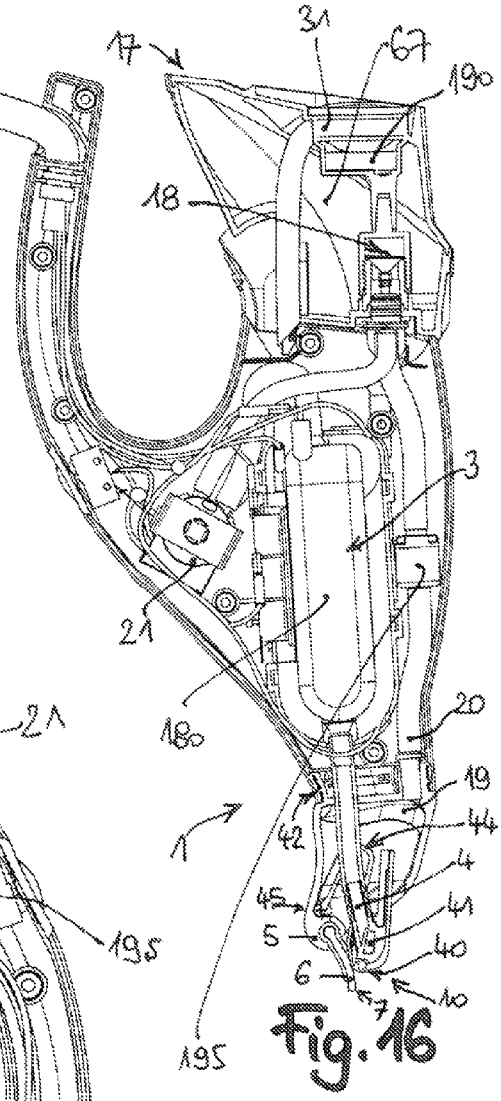
FIG. 16 shows, similarly to FIG. 15, a variant of an embodiment.

FIG. 16 shows filtering means 190 installed at the level of such a tank with recycling of the liquid by filtering.

The simplified alternative variant of a single tank without recycling of water permits to work in all positions.

The household electrical appliance advantageous includes vapor-generating means, which integrate at least one heating means 180, which includes an armored resistance having a large developed length and for example in the shape of a double U, as can be seen in FIG. 18, so as to surround a chamber 181 that includes at least one tube 182 through which passes the fluid to be heated, preferably water. The armored resistance can include a cladding formed of a coating or/and a ceramic jacket, or, in a preferred embodiment, by ceramic powder packed around an electric filament, inside a namely metallic tube.

This heating means 180 advantageously adopts all or part of the features set forth in patent application FR 2 909 275, or/and in application FR 2 924 322, both of the same applicant. The tube 182 can be surrounded by another ceramic tube or by a coating ceramic form, the whole is molded, in particular in a shell of light alloy, aluminum alloy or the like, or of any other adequate material, for example a resin or a plastic. The tube 182 is preferably inclined, in order to achieve a maximum reduction of the volume.

This tube 182 is advantageously a welded and tight, corrosion resistant and seamless stainless steel, light-alloy or copper tube preventing any corrosive attack of water or liquid to this light-alloy shell, containing this armored resistance, and preventing any escape that could be related to seams or a defective screwing in the light alloy.

The use of welding prevents any problem of tightness at the level of the fluid circulation.

The double insulation provided, on the one hand, by a ceramic tube or jacket and, on the other hand, by the insulation itself of the armored resistance, provides the whole of this heating body the possibility of classification as double insulation, referred to as class 2, which allows, while avoiding a grounding lead, minimizing the constraints related to the electric supply cord: cost, flexibility, weight. In a preferred embodiment, there is thus both a seamless stainless-steel shielding and a double ceramic shielding, and thus a great reliability and a great safety of use, at low cost.

The invention has many advantages. The use of vapor allows maintaining the temperature in the vicinity of the cleaning area. The circulation of the fluids, in particular with their re-use, ensures a renewal of the cleaning flow, and a great effectiveness. These arrangements also permit to prevent any clogging of the absorbent substrate implemented by the invention.

The invention is very simple and provides a very light and handy appliance. The circulations permit to use the laws of gravity for the collection of the residues. The invention can do without suction means, which does in no way prevent it from being coupled to such means, within appliances including a body movable on the floor.

I claim:

1. A scraper for smooth surfaces, being connected to a liquid and/or vapor tank, said scraper comprising:

means for projecting liquid, vapor, or both, onto a work surface through at least one opening, and a scraping body provided with at least one resilient scraping element, each resilient scraping element comprising at least one ridge formed by intersection of an edge and a protruding face of said scraping body, said ridge scraping said work surface during a movement imparted to said scraper, wherein said scraper collects washing residues and wherein said scraping body further comprises, in a vicinity of the scraping element and at least towards or on one surface of the latter, means for collecting residual liquid on at least one absorbent substrate guiding the residual liquid connected to a tank by a conduit, wherein said means for collecting residual liquid comprises an end surface entering into contact or nearing said surface of said scraping element, and wherein said liquid collection tank is located in the lower portion of the scraper and comprises a displacement preventing means, in order to prevent any displacement of water when the scraper is tilted, said displacement preventing means having an inlet in the upper portion of said liquid collection tank or a non-return valve.

2. Scraper according to claim 1, wherein said means for collecting residual liquid are movable in rotation, in translation, or both either with respect to said scraping body, which they are connected to by springy restoring means and by pivoting means, or with respect to an end of said scraper for gripping by the user or being connected to an appliance handled by the user.

3. Scraper according to claim 2, wherein, in a free state, said surface and said end surface are separated from each other under the action of said springy restoring means and said pivoting means, and that, under an action of displacement and/or pressure by the user of said scraper on a work surface, said surface and said end surface are brought closer to each other.

4. Scraper according to claim 1, wherein said at least one absorbent substrate is positioned in front of said at least one opening, so that the projected liquid, vapor, or both flow passes through said projection means.

5. Scraper according to claim 1, wherein said at least one absorbent substrate is positioned above said at least one opening, so that the projected liquid, vapor, or both flow passes through said projection means.

6. Scraper according to claim 1, wherein said at least one absorbent substrate is positioned below said at least one opening, so that the projected liquid, vapor, or both flow passes through said projection means.

7. Scraper according to claim 1, wherein said at least one opening is positioned between said surface and said end surface so as to project a flow of liquid, vapor, or both between said surface and said end surface.

8. Scraper according to claim 1, wherein said scraping body further comprises, in the vicinity of said scraping element and on each surface of the latter protruding out of said scraping body, means for collecting residual liquid on said at least one absorbent substrate guiding the residual liquid connected through the conduit to the tank.

9. Scraper according to claim 1, wherein said at least one absorbent substrate guiding the residual liquid is formed of at least one spongy body collecting residual liquid and transmitting the liquid, by gravity, through the conduit towards the tank.

10. Scraper according to claim 1, wherein said at least one absorbent substrate is a substrate rotating about an axis of rotation, subjected to the action of springy restoring means and pivoting means.

11. Scraper according to claim 10, wherein said rotary substrate is combined with at least two scrapers located on both sides of said axis of rotation.

12. Scraper according to claim 1, further comprising:

an accumulation chamber between said at least one absorbent substrate guiding the residual liquid and said conduit.

13. Scraper according to claim 1, wherein said at least one absorbent substrate is directly under the scraping element, which includes a not very deformable V-shaped scraping front, on a surface of which rest grooves or channels, guide the liquid or gas towards the area of contact with a surface to be cleaned or/and, facilitate the draining into said absorbent substrate by addition of air and said at least one absorbent substrate being maintained in front of said surface by the angle or the shape of the profile of said scraping front.

14. Scraper according to claim 1, wherein said conduit is connected to a liquid collection tank being comprised of one single tank for a clean liquid and collected residual liquid, a clean liquid chamber supplied through a conduit provided with openings, and a residual-liquid chamber supplied through a conduit connected to said conduit or formed by said conduit, the chambers being separated from each other by a deformable flexible partition and fixed to a wall of said tank around said conduit.

15. Scraper according to claim 1, wherein said conduit is connected to a liquid collection tank being comprised of one single tank for a clean liquid and residual liquid collected, residual liquid being filtered through filtering means or an intermediate filter partition separating a first inlet chamber for said residual liquid and a second chamber for recycled liquid.

* * * * *